US005853605A

United States Patent [19]

Comarteau et al.

[11] Patent Number: 5,853,605

[45] Date of Patent: Dec. 29, 1998

[54] LIQUID METAL POURING DUCT, PROCESS AND DEVICE FOR HOMOGENIZING METAL

[75] Inventors: Jean-Louis Comarteau, Chatenoy-le-Royal; Christophe Liebaut, Mercurey; Patrice Nykiel, Beaumont-sur-Crosne; Alain Remy, Chalon-sur-Saone, all of France

[73] Assignee: SEVA, Chalon-Sur-Saone, France

[21] Appl. No.: 849,378

[22] PCT Filed: Dec. 5, 1995

[86] PCT No.: PCT/FR95/01602

§ 371 Date: Aug. 8, 1997

§ 102(e) Date: Aug. 8, 1997

[87] PCT Pub. No.: WO96/17703

PCT Pub. Date: Jan. 13, 1996

[30] Foreign Application Priority Data

Dec. 9, 1994 [FR] France ..... 94 15026

[51] Int. Cl.[6] ..... B22D 35/06

[52] U.S. Cl. ..... 222/593; 266/237

[58] Field of Search ..... 222/593, 590, 222/591; 266/237, 236

[56] References Cited

U.S. PATENT DOCUMENTS 4,475,721 10/1984 Pamart ..... 222/593

FOREIGN PATENT DOCUMENTS 103220 3/1984 European Pat. Off. .
2670697 6/1992 France .
2701225 8/1994 France .

*Primary Examiner*—Scott Kastler
*Attorney, Agent, or Firm*—Sughrue, Mion, Zinn, Macpeak & Seas, PLLC

[57] ABSTRACT

A liquid metal casting conduit (1) is shaped as a partial torus and has an inductor (3) embedded in concrete and whose turns are asymmetrical with respect to the axes (XX') and (YY') of the conduit. It is used for to the homogenization of the metal temperature when the conduit is secured to a low pressure casting ladle (7).

6 Claims, 2 Drawing Sheets

LIQUID METAL POURING DUCT, PROCESS AND DEVICE FOR HOMOGENIZING METAL

BACKGROUND OF THE INVENTION

The present invention concerns pouring liquid metal in order to manufacture objects from steels, superalloys and other ferrous or non-ferrous metal alloys.

The invention relates, in the first place, to a pouring duct incorporating a closed cross section opening, at one end, into a pouring orifice in order to feed at least one mold, and of the type comprising, along its length, at least one heating element composed of an induction through whose cooled turns an alternating electric current (~, U,F) flows. The coil is embedded in concrete surrounding a heat-resistant tube (see, for example, U.S. Pat. No. 5,708,257 in the Applicant's name). This duct proves especially advantageous for pouring metals having high melting points.

This heating duct eliminates the danger of cooling and solidification of a metal alloy having a pouring temperature of at least 1,400° C. between two successive pouring operations.

Furthermore, this duct configuration yields a number of advantages over the conventional state of the art, these advantages being described, for example, in U.S. Pat. No. 4,475,721 in the name of Pont-a-Mousson SA and relating to the simplicity of manufacture of the duct (see U.S. Pat. No. 5,708,257 in the Applicant's name).

However, a number of heterogeneous temperature phenomena can be observed in this type of duct, which become more pronounced when the duct is rounded. As a consequence, metal-filling and -solidification differences occur in the casting mold.

SUMMARY OF THE INVENTION

This invention is intended to solve these problems. In particular, the homogeneous temperature of the metal ensures the uniformity of the conditions for filling and solidification of complex or multiple impressions in a casting mold, thereby making it possible to strictly control the defect rates (shrink cavities, cracks, etc.) found on the objects. The duct according to the invention gives such results because of asymmetrical induction coil turns. To make uniform the longitudinal temperature variation of the metal, the turns in the inductor are shifted and the density thereof increases at the end of the pouring orifice designed for feeding the mold.

To make uniform the transverse variations of the metal temperature, the inductor turns form a spiral which is offset, in relation to the duct, toward the axis of rotation of the covering torus of this duct.

In accordance with other variants:

the turns of the inductor are circular in shape, or the turns of the inductor have an elliptical shape.

The invention also concerns a process intended to yield the same results. This process for achieving homogenization of the temperature of a metal circulating in a duct in the shape of a partial torus of the type described above is characterized by the fact that an electric current having a frequency of less than 15,000 Hz is fed to the inductor.

The invention also concerns a low-pressure metal pouring unit comprising a foundry ladle incorporating a pressurized gas source which opens into the upper part of the ladle and a metal-outlet orifice, this unit being characterized by the fact that the outlet orifice empties into a duct conforming to the duct described above.

BRIEF DESCRIPTION OF THE FIGURES

One embodiment of the invention will now be described with reference to the attached drawings, in which.

DETAILED DESCRIPTION OF THE PREFERRED EMBODIMENT

Figure 1:
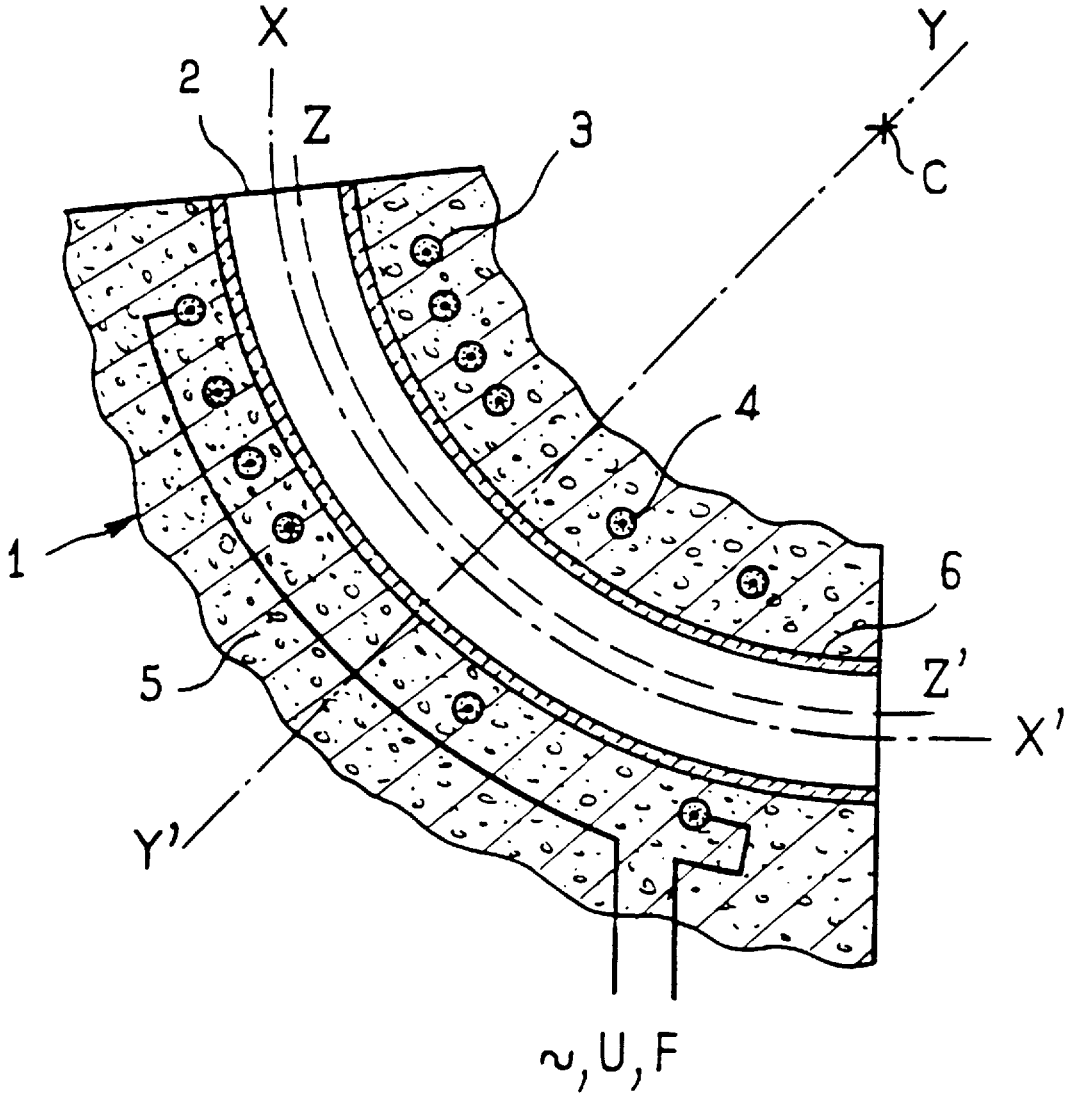
FIG. 1 is a vertical cross-section of a heated pouring duct according to the invention.

The apparatus shown in FIG. 1 is a duct 1 having a closed cross-section which opens at one end through an orifice 2 and comprises, over the length thereof, a heating element constituted by a coil-shaped inductor 3 through whose cooled turns 4 an alternating electric current (-, U,F) travels. This inductor 3 is embedded in concrete 5 surrounding a heat-resistant tube 6. The turns 4 are asymmetrical in relation to the axes of symmetry of the duct X--X' and Y--Y'. The duct is shaped like a partial torus, the axis of rotation of which passes through a point C. The axis X--X' corresponds to the axis of the duct. The axis Y--Y' corresponds to the radius of curvature passing through point C and is in the median position with respect to the two ends of the duct. The density of the turns 4 is greater at the end portion incorporating the pouring orifice 2, since these turns are closer together on this side of the axis Y--Y'. The inductor is shaped like a spiral, whose axis Z--Z' is closer to point C than is the axis X--X', with the result that the coil turns are shifted toward the inside of the concavity of the duct.

Figure 2:
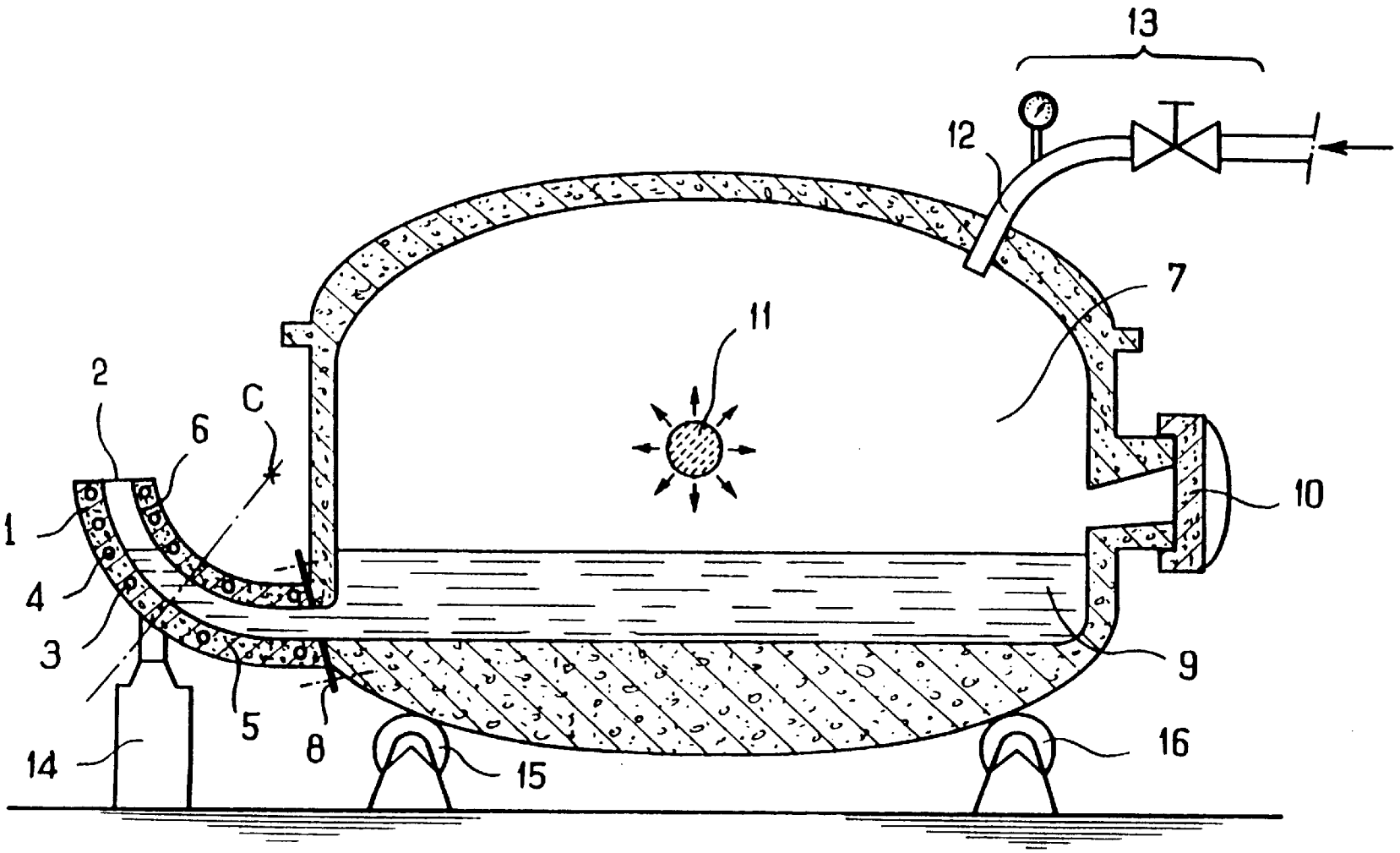
FIG. 2 is a vertical cross-section of a reduced-pressure metal pouring unit comprising a duct of the type described in FIG. 1.

The unit illustrated in FIG. 2 is a pouring apparatus comprising a ladle 7 to which the duct 1 is fastened by a clamping device 8 known in accordance with the state of the art. The ladle and duct hold liquid metal 9, which is supplied through a lateral filling door 10. The ladle incorporates a graphite rod 11 which is heated to high temperature and radiates on the metal surface.

The upper part of the ladle comprises a duct 12, which feeds a pressurized gas flow into the ladle above the molten metal bath.

A pressure-control apparatus 13 mounted on the duct 12 comprises a pressure-measuring device and a valve. A block 14 positioned beneath the duct 1 makes it possible to set the pouring position. The ladle can be inclined by rotation on a system of rollers 15 and 16. The low-pressure pouring unit works in the following way: The ladle is filled with metal 9. A mold (not shown) is brought into contact with the outlet orifice 2. The mold is filled by applying the pressure of the gas issuing from the duct 12 to the surface of the metal. Several molds are filled in succession. The pouring duct 1 keeps the temperature of the metal homogeneous during and between each mold-filling operation, using the inductor fed with alternating current.

Following the multiple-mold pouring cycle, the metal remaining at the bottom of the ladle is drained away through the filling door 10 by rotation on the rollers 15 and 16.

We claim:

1. An elongate duct (1) for pouring liquid metal to feed a casting mold, the duct having a closed cross-section opening at one, exit end to define a pouring orifice (2) for feeding said mold, said duct comprising, over its length, a heating element constituted by a coil-shaped inductor (3) through whose cooled turns (4) an alternating electric current flows, said inductor being embedded in concrete (5) surrounding a heat-resistant tube (6), wherein the inductor turns as a whole are asymmetrically disposed in both a longitudinal direction of the duct, being more closely spaced proximate said exit end, and in a transverse direction of the duct such that a longitudinal axis of the inductor turns is laterally offset from a longitudinal axis of the duct, so as to make the temperature of the metal (9) homogeneous.

2. A duct according to claim 1, wherein the density of the turns increases as they approach the pouring orifice.

3. A duct according to claim 1 in the form of a partial torus, wherein the inductor (3) forms a spiral having a longitudinal axis (Z, Z') positioned closer to the axis of rotation of the torus than the longitudinal axis (X--X') of the duct.

4. A duct according to claim 1, wherein the individual turns of the inductor are circular in shape.

5. A duct according to claim 1, wherein the individual turns of the inductor have an elliptical shape.

6. A duct according to claim 3, wherein said partial torus has a constant radius of curvature.

* * * * *